US009279315B2

(12) United States Patent
Dykstra

(10) Patent No.: US 9,279,315 B2
(45) Date of Patent: Mar. 8, 2016

(54) INJECTION WELL AND METHOD FOR DRILLING AND COMPLETION

(71) Applicant: Halliburton Energy Services, Inc., Houston, TX (US)

(72) Inventor: Jason D. Dykstra, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/368,239

(22) PCT Filed: Dec. 21, 2012

(86) PCT No.: PCT/US2012/071155
§ 371 (c)(1),
(2) Date: Jun. 23, 2014

(87) PCT Pub. No.: WO2014/098882
PCT Pub. Date: Jun. 26, 2014

(65) Prior Publication Data

US 2015/0252657 A1 Sep. 10, 2015

(51) Int. Cl.

| | |
|---|---|
| ***E21B 43/16*** | (2006.01) |
| ***E21B 7/04*** | (2006.01) |
| ***E21B 43/24*** | (2006.01) |
| ***E21B 33/12*** | (2006.01) |

(52) U.S. Cl.
CPC . *E21B 43/16* (2013.01); *E21B 7/04* (2013.01); *E21B 7/046* (2013.01); *E21B 33/12* (2013.01); *E21B 43/24* (2013.01)

(58) Field of Classification Search
CPC ..... E21B 43/16; E21B 33/12; E21B 7/046
See application file for complete search history.

(56) References Cited

U.S. PATENT DOCUMENTS

| | | | | |
|---|---|---|---|---|
| 4,386,665 | A | 6/1983 | Dellinger | |
| 5,226,495 | A | 7/1993 | Jennings | |
| 6,708,764 | B2 * | 3/2004 | Zupanick | 166/313 |
| 7,311,150 | B2 * | 12/2007 | Zupanick | 166/311 |
| 7,360,595 | B2 * | 4/2008 | Zupanick et al. | 166/245 |
| 7,404,439 | B2 * | 7/2008 | Schuh | 166/272.3 |
| 8,555,961 | B2 * | 10/2013 | Koloy et al. | 166/179 |
| 2004/0007351 | A1 | 1/2004 | Zupanick | |
| 2006/0131029 | A1 * | 6/2006 | Zupanick | 166/370 |
| 2006/0175061 | A1 * | 8/2006 | Crichlow | 166/302 |
| 2007/0175638 | A1 * | 8/2007 | Crichlow | 166/302 |
| 2008/0011484 | A1 * | 1/2008 | Schuh | E21B 43/305 166/303 |
| 2009/0084534 | A1 * | 4/2009 | Zupanick | E21B 43/305 166/50 |
| 2009/0179383 | A1 * | 7/2009 | Koloy et al. | 277/338 |
| 2011/0272153 | A1 * | 11/2011 | Boone et al. | 166/270 |
| 2012/0043081 | A1 | 2/2012 | Kjorholt | |

FOREIGN PATENT DOCUMENTS

WO 2004083706 A1 9/2004

OTHER PUBLICATIONS

International Search Report and Written Opinion dated Sep. 4, 2013 for Application No. PCT/US2012/071155.

* cited by examiner

*Primary Examiner* — Angela M DiTrani
*Assistant Examiner* — Crystal J Miller
(74) *Attorney, Agent, or Firm* — Chamberlain Hrdlicka

(57) ABSTRACT

Disclosed is a method and apparatus for completing an injection well, wherein the horizontally-extending portion of the well is drilled in a wave pattern. Injection and hydrocarbon recovery sections or alternatively spaced along the horizontally-extending portion and are isolated from each other by packers in the wellbore. The injection and hydrocarbon recovery sections are positioned at the opposed peaks of the wave pattern.

5 Claims, 4 Drawing Sheets

INJECTION WELL AND METHOD FOR DRILLING AND COMPLETION

CROSS REFERENCE TO RELATED APPLICATIONS

None.

BACKGROUND

1. Technical Field

The present invention relates to methods of producing hydrocarbon fluids from a subterranean well, using stem injection.

2. Background Art

In some areas of the world, there are large deposits of very viscous or heavy crude oils, in formations, such as shale and tar sands. One especially effective technique used in the past for producing such heavy tar or oil sand formations has been steam flooding of the formation. In steam flooding, a pattern of wells is drilled vertically through heavy oil bearing formation. Casing is put in place and perforated in the producing interval and then steam generated at the surface is pumped under relatively high pressure down the casing and into the formation. In some instances the steam may be pumped for a while into all of the wells drilled into the producing formation and, after the heat has been used to lower the viscosity of the heavy oil near the wellbore, then the steam is removed and the heated, lowered viscosity oil is pumped to the surface, having entered the casing through the perforations. When the heat has dissipated and production falls off, the production is closed and the steam injection is resumed. Where the same wells are used to inject steam for a while and then are used for production, this technique has been known as the huff-and-puff method or the push-pull method. Production from this single well is limited by the penetration of steam in the formation around the wellbore.

In other instances, multiple wells penetrating the heavy oil bearing formation are used to continuously inject steam, while others are used to continuously produce lower viscosity oil heated by the steam. This multiple well method can result in larger and more efficient production of heavy oil but involves the increased costs of drilling multiple wells. Again, when production falls off due to lack of heat, the role of the injectors and producers can be reversed to allow injected steam to reach new portions of the reservoir and the process repeated.

SUMMARY OF THE INVENTIONS

The present invention provides a method of drilling and completing wells for use in injecting steam into a formation using a single well with the advantages of a multiple well injections.

Due to the increased capabilities of directional drilling, certain profiles can be drillled that had not been possible in the past. We can take advantage of this process, coupled with a completion design, to reduce the cost of injection stimulated well.

The well is drilled with a wave pathway in the hydrocarbon bearing zone. The wave pathway osculates vertically, horizontally or in both directions. In one example, a sinusoidal pathway is used. The well is completed with alternating spaced injection and production ports along the length of the wellbore. Packers can be installed in the wellbore to isolate the injection and production ports. In one embodiment, the packers are swellable packers.

BRIEF DESCRIPTION OF THE DRAWINGS

The drawing is incorporated into and forms a part of the specification to illustrate at least one embodiment and example of the present invention. Together with the written description, the drawing serves to explain the principles of the invention. The drawing is only for the purpose of illustrating at least one preferred example of at least one embodiment of the invention and is not to be construed as limiting the invention to only the illustrated and described example or examples. The various advantages and features of the various embodiments of the present invention will be apparent from a consideration of the drawing in which.

DETAILED DESCRIPTION

The present invention provides an improved well design and method for use in steam injection processes to recover hydrocarbons. The present invention's particular applicability is to the use of a wave-like well configuration with alternating injection and production locations, separated by packers.

Figure 1:
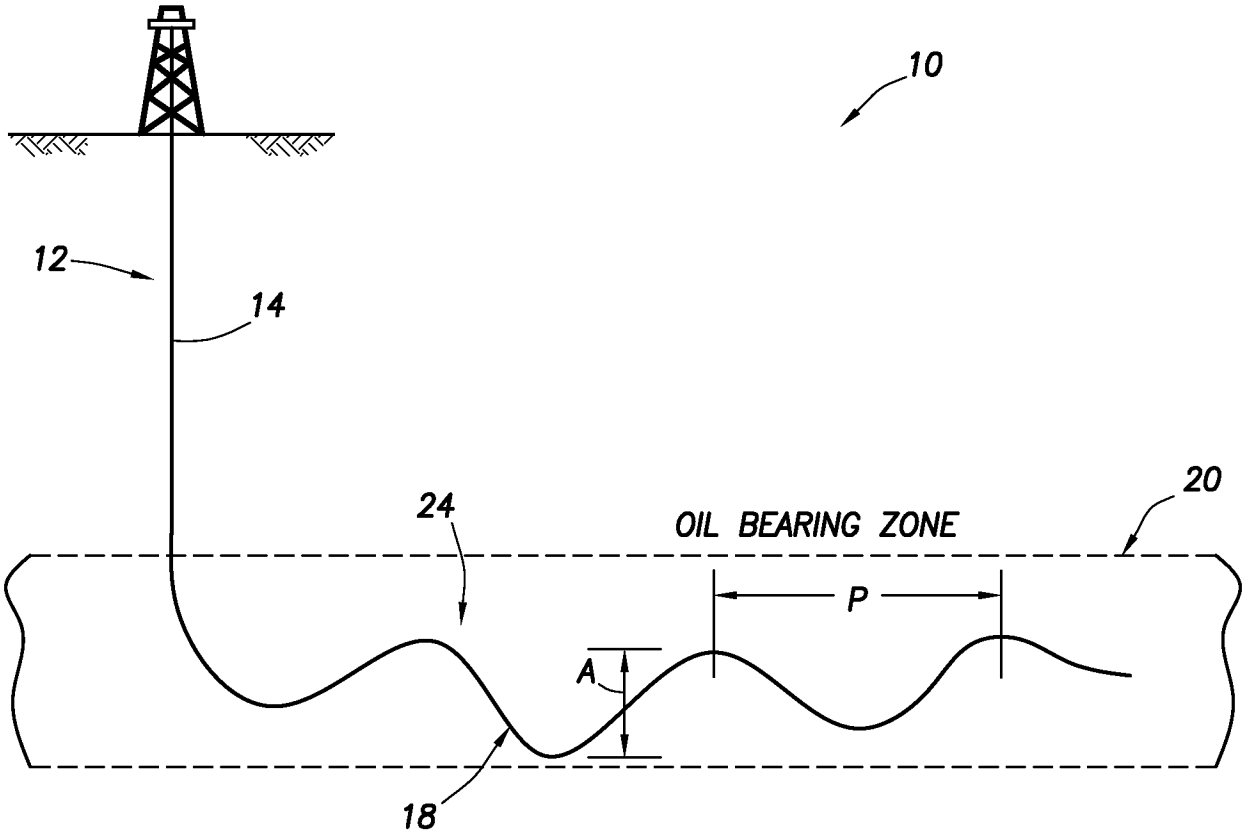
FIG. 1 is a partial section view of a well configuration of the present invention.

Referring more particularly to the drawings, which are not intended to be to scale or in proportion, wherein like reference characters are used throughout the various figures to refer to like or corresponding parts, there is shown in FIG. 1 one embodiment of the injection well configuration embodying principles of the present invention that is schematically illustrated and generally designated by reference numeral 10. In the illustrated embodiment, a wellbore 12 extends through various earth strata. Wellbore 12 is a substantially vertical section 14, the upper portion of which has installed therein a casing string 16 cemented in the wellbore 12. Wellbore 12 also has a horizontally-extending section 18 that extends through one or more hydrocarbon bearing subterranean formations 20. In the illustrated example, formation 20 contains heavy hydrocarbon deposits of the type that is suitable for steam injection techniques. Although not illustrated in FIG. 1, a tubing string 22 is installed in the horizontally-extending section 18 with isolating packers, valves and other equipment, as will be described in detail herein.

In the exemplary embodiment, the wellbore 12 is cased. The casing may be cemented to the formation. There are a number of factors that go into the decision of whether to case the wellbore 12 and whether to cement the casing to the formation. A person of ordinary skill in the art should know whether the wellbore 12 needs to be cased. In most cases, it will be beneficial to do so. As illustrated, the horizontally-extending portion section 18 of wellbore 12 is also cased; however, the principles of the present invention would apply as well to an uncased open hole well completion.

As illustrated in FIG. 1, using steerable drilling techniques the horizontally-extending section 18 can be drilled in a vertically varying wave pattern 24 within the boundaries of the hydrocarbon formation 20. The term "vertical" as used to describe the wave pattern 24 of the FIG. 1 embodiment, with respect to gravitational forces. For example, vertically up would indicate a direction opposite to gravitational force and vertically down would indicate a direction in the direction of gravitation force. The vertically varying waveform pattern 24 which substantially defines in a vertical plane. The term "waveform" wellbore pattern is used herein to refer to a wellbore that does not substantially extend in a straight line and has portions of the wellbore that pass through spaced vertical and/or horizontal positions in the formation.

In the FIG. 1 embodiment, the wave pattern 24 closely approximates a sine wave, with the period "P" (distance between the wave peaks) extending and be measured in a horizontal direction. The peak-to-peak amplitude "A" would extend and be measured in a vertical direction. As used herein, the term "peak" is use to refer to those points or sections where the waveform changes direction. In this embodiment, the upper peak is located at the point or in the area where the wellbore changes direction from having an upward slope to having a downward slope. Likewise, a lower peak is located at the point or in the area where the wellbore changes direction from having a downward slope to having an upward slope. This particular vertically undulating pattern is ideally suited for thicker formations and has the advantage of producing from a larger area the formation.

Figure 2:
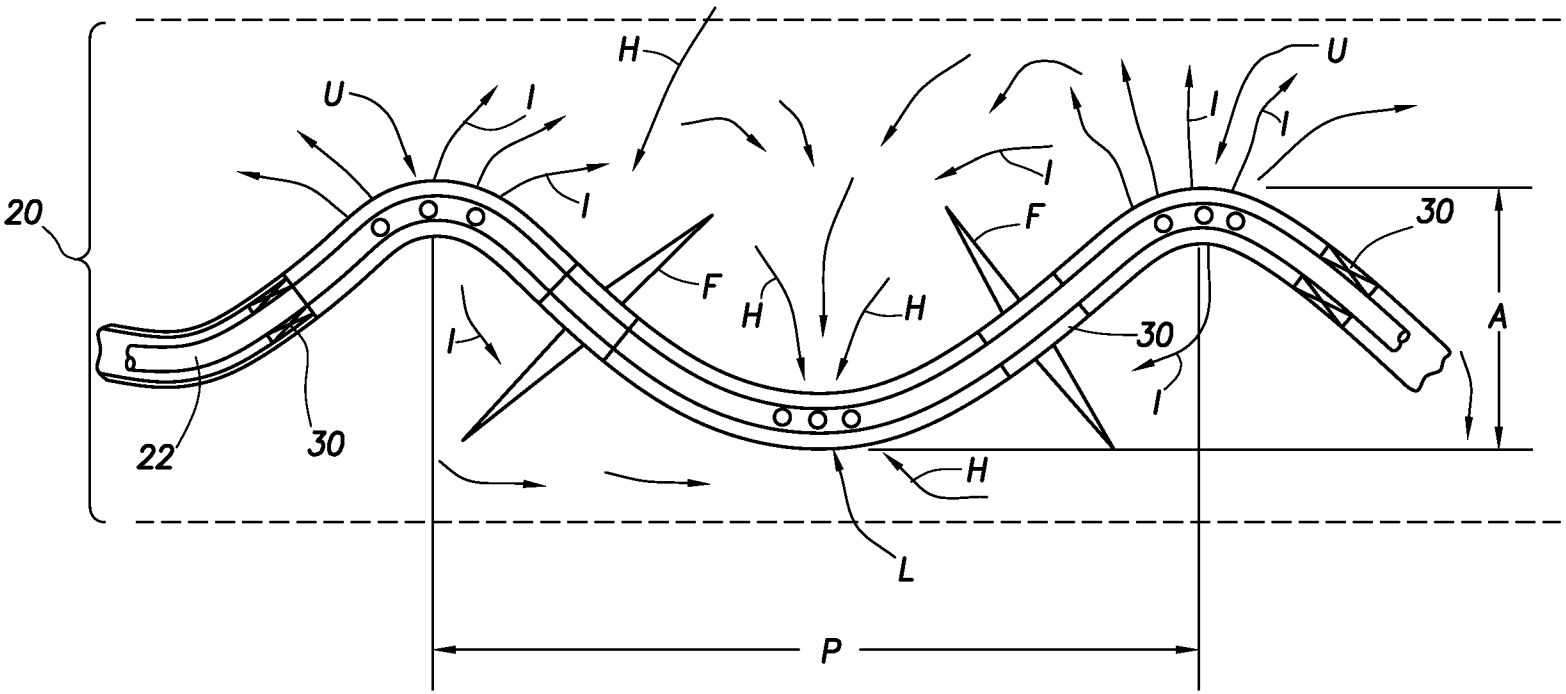
FIG. 2 is an enlarged, partial section view of the well configuration of FIG. 1.

The completion details of the wave pattern 24 will be described by reference to FIG. 2. In FIG. 2, the tubing string 22 (extending from the surface) is illustrated positioned within a portion of the horizontal section 18 of the wellbore 12, as extending from the surface. The upper peaks "U" comprise steam injection sections, while the lower valleys "L" comprise hydrocarbon recovery are production sections.

According to the methods of the present invention, steam designated by reference numeral "I," is injected into the formation 20 at the upper peaks "U." As the steam floods the upper portion of the formation hydrocarbons, designated by reference numeral "H" will flow toward the wellbore and into the tubing 28. By using a wave pattern 24 that extends horizontally and has steam injection sections and hydrocarbon recovery sections that are separated vertically, hydrocarbon production will be enhanced. It is envisioned, of course, that the relative vertical positions of the injection and recovery sections could be reversed as dictated by the formation makeup and hydrocarbon materials to be recovered.

Positioned within tubing string 22 are a plurality of longitudinally-spaced packer assemblies 30. As is illustrated in FIG. 2, the packer assemblies 30 seal off the wellbore around the tubing 28 to isolate the vertically upper peaks "U" from the vertically lower peaks "L." In this embodiment, the packers 30 comprise swellable material positioned in the annulus around the tubing string. When the swellable material of packer assemblies 30 comes into contact with an activating fluid, such as a hydrocarbon fluid, water or gas, the swellable material radially expands to seal against the wall of the wellbore (whether it is cased or an open hole). In this manner, the swellable material acts as a packer to pack off the annular space formed between the packer assembly 30 and the wellbore. It is envisioned, of course, that other packer configurations well known in the art could be utilized, including, for example, those having elastomeric packing elements and optional slip assemblies.

As used herein, a material is characterized as swellable when it swells upon contact with an aqueous fluid (e.g., water), an oil-based fluid (e.g., oil) or a gas. Suitable swellable particles are described in the following references, each of which is incorporated by reference herein in its entirety: U.S. Pat. No. 3,385,367, U.S. Pat. No. 7,059,415, U.S. Pat. No. 7,578,347, U.S. Pat. App. No. 2004/0020662, U.S. Pat. App. No. 2007/0246225, U.S. Pat. App. No. 2009/0032260 and WO2005/116394.

Even though FIG. 1 depicts tubing string as including only packer assemblies 30 and injection and recovery sections, those skilled in the art would recognized that tubing string 22 may include a number of other tools and systems such as fluid flow control devices, communication systems, safety systems and the like.

Sliding sleeve valves (not illustrated) could be utilized to selectively control the injection of steam into the formation and flow of hydrocarbons out of the formation. By manipulating sleeve valves, the various wave configurations of the present invention could be used to perform the huff-and-puff method. Also, by using crossover tools and other apparatus well known in the art, the injection section of the tubing 22 could be isolated from the production section of tubing 22, with both sections having an independent flow path to the surface. With the well 10 completed in this manner, steam could be continuously injected into the formation while hydrocarbons were continuously recovered.

In addition, one or more production fractures could be formed in or along the horizontal wellbore section 18, using a variety of techniques. In one exemplary embodiment, a plurality of fractures are formed by using a hydra jetting tool, such as that used in the SurgiFrac® fracturing service offered by Halliburton Energy Services, Inc. in Duncan, Okla. In this embodiment, the hydra jetting tool forms each fracture, one at a time. Each fracture may be formed by the following steps: (i) positioning the hydra jetting tool in the wellbore at the location where the fracture is to be formed, (ii) perforating the reservoir at the location where the fracture is to be formed, and (iii) injecting a fracture fluid into the perforation at sufficient pressure to form a fracture along the perforation. As those of ordinary skill in the art will appreciate, there are many variations on this embodiment.

The fractures may take a variety of geometries, but preferably, the fractures extend transverse to the wellbore so that the fractures extend at a substantially right angle with respect to the wellbore longitudinal axis. In some embodiments, the fractures may be formed along natural fracture lines and may generally be parallel to one another. The fracture's shape, size and orientation can be determined by the orientation of the fluid nozzles and movement thereof. Using hydrajetting radially from a vertical wellbore, a transversely-extending fracture can be formed and may extend from about 50 ft to about 1000 ft. from the wellbore.

In another alternative embodiment, fracture barriers, identified by reference numeral "F" in FIG. 2, are formed, extending from the wellbore at location positioned between the injection and productions sections of the wellbore. The fractures could be filled with materials which form an impervious layer in the formation that alters the fluid flow path in the formation. These materials well known in the art and include swellable rubber materials, cemented, and pardonable polymers and the like. By creating these fracture barriers, the sweeping effect of steam as it flows through the formation and to the production section is improved.

Figure 3:
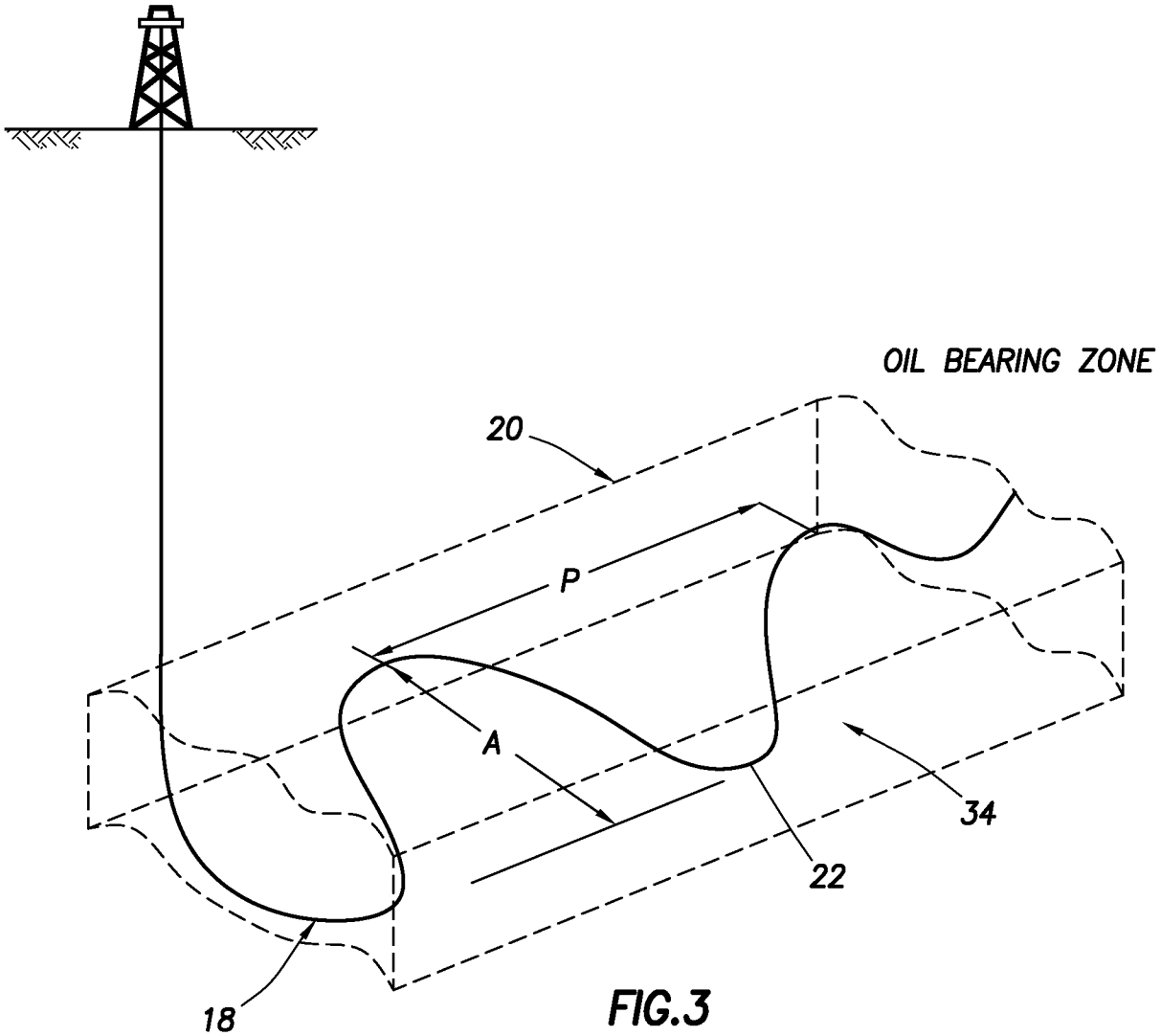
FIG. 3 is a partial section view of an alternative well configuration of the present invention.

Turning now to FIG. 3, an alternative drilled wellbore wave pattern 34 suitable for a vertically narrower formation 20 is illustrated. Again, the pattern 34 approximate a sine of wave. In this embodiment, the wave pattern lies in a horizontally-extending plane, with the period "P" measured in the horizontal direction with the aptitude "A" also measured in the horizontal direction. The above description of the completion architecture, by reference to FIG. 2, applies equally to the wave pattern 34.

Figure 4A:
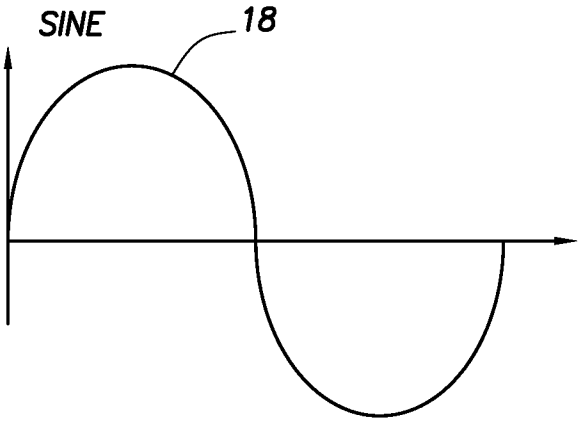
FIGS. 4A-D are diagrams of alternative embodiments of the wellbore wave pattern.
Figure 4B:
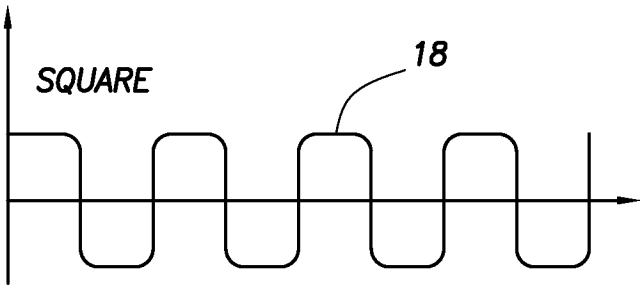
Figure 4C:
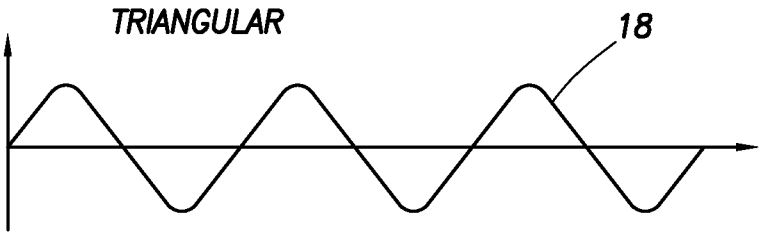
Figure 4D:
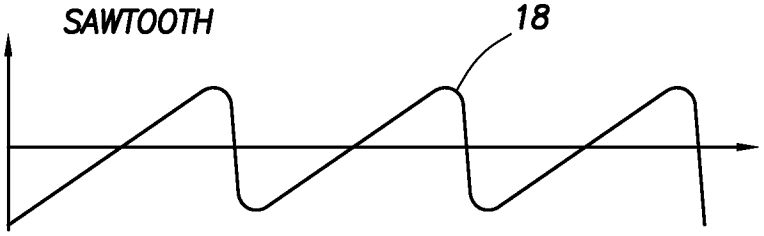

Turning now to FIGS. 4A-4D, alternative waveform configurations of the horizontally-extending wellbore portion 18 suitable for use in practicing the present invention are illustrated. In FIG. 4A, the wellbore portion 18 is drilled in a generally sinusoidal pattern, wherein the peak to peak and period and amplitude or approximately equal. In FIG. 4B, the wellbore portion 18 is drilled in a generally rectangular waveform. It is also envisioned that a generally square wave pattern could be used. In FIG. 4C, the wellbore portion 18 is drilled in a generally triangular waveform. In FIG. 4D, the wellbore portion 18 is drilled in a generally sawtooth waveform. As illustrated, waveforms in FIGS. 4B-4D are rounded off on their peaks to accommodate the directional drilling techniques well known in the industry. It is also envisioned that the various waveforms disclosed herein could be combined in one well. For example, as a horizontal portion extends out into the formation the thickness of the formation may vary, requiring the use of both the pattern illustrated in FIG. 1 and the pattern illustrated in FIG. 3.

Accordingly, it should be understood by those skilled in the art that the use of directional terms, such as above, below, upper, lower, upward, downward and the like are used in relation to the illustrative embodiments as they are depicted in the figures, the upward direction being toward the top of the corresponding figures in a downhole direction being toward the bottom of the corresponding figure. Likewise, even though FIGS. 1-2 depict the injection well configurations of the present invention in a wellbore having a single wellbore, it should be understood by those skilled in the art that the injection well configurations of the present invention are equally well-suited for use in multilateral wellbores having a main wellbore in a plurality of branch wellbores.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

The invention claimed is:

1. A method of producing hydrocarbons from a subterranean formation, comprising:

drilling a wellbore with a horizontally-extending portion having spaced-apart upper and lower peaks;

installing a tubing string in the horizontally-extending portion with the tubing string extending from the well surface;

injecting fluids into the wellbore via the tubing string at an upper peak of the wellbore;

installing packers around the tubing string to seal off the annular space between the tubing string and the wellbore; and flowing hydrocarbons into the tubing string at a lower peak of the wellbore.

2. The method of claim 1, wherein installing packers further comprises positioning the packers in the wellbore between at least one upper peak and one lower peak.

3. The method of claim 1, wherein installing packers further comprises providing a swellable material into the wellbore and radially swelling the swellable material to block the annular space between the wellbore and tubing member.

4. A system for producing hydrocarbons from a subterranean formation, the system comprising:

a first vertically extending wellbore section extending from a well surface to the formation;

a second wellbore section extending horizontally from the first wellbore section and comprising spaced apart upper and lower peaks;

a tubing string in the second wellbore section extending to the well surface;

a packer on the tubing string and located in the well between an upper peak and a lower peak;

a fluid injection flow path through the tubing string to an upper peak of the wellbore; and a hydrocarbon fluid flow path through the tubing string to a lower peak of the wellbore for hydrocarbons to flow into the wellbore via the tubing string.

5. The system of claim 4, wherein the packer comprises swellable material.

* * * * *